US009265306B2

(12) United States Patent
Lindfors

(10) Patent No.: US 9,265,306 B2
(45) Date of Patent: Feb. 23, 2016

(54) DETACHABLE COVER FOR A BUTTON

(76) Inventor: Nils Lindfors, Kalmar (SE)

( * ) Notice: Subject to any disclaimer, the term of this patent is extended or adjusted under 35 U.S.C. 154(b) by 261 days.

(21) Appl. No.: 13/583,045

(22) PCT Filed: Mar. 10, 2011

(86) PCT No.: PCT/SE2011/000044
§ 371 (c)(1),
(2), (4) Date: Oct. 23, 2012

(87) PCT Pub. No.: WO2011/112135
PCT Pub. Date: Sep. 15, 2011

(65) Prior Publication Data

US 2013/0167330 A1 Jul. 4, 2013

(30) Foreign Application Priority Data

Mar. 10, 2010 (SE) ..... 1000222

(51) Int. Cl.
*A44B 1/14* (2006.01)

(52) U.S. Cl.
CPC . *A44B 1/14* (2013.01); *Y10T 24/367* (2015.01)

(58) Field of Classification Search
CPC ..... A44B 1/12; A44B 1/14; Y10T 24/367; Y10T 24/3672; A45C 1/00; A45C 1/02; A45C 11/32
USPC ..... 24/113 MP, 113 R, 90.5, 108; 206/37; 150/150, 900; 383/43; D11/228
See application file for complete search history.

(56) References Cited

U.S. PATENT DOCUMENTS 1,180,104 A * 4/1916 Barnes ..... 15/257.01
1,329,155 A * 1/1920 Aaron ..... 30/91.2
2,667,906 A * 2/1954 Stiller ..... 150/150

(Continued)

FOREIGN PATENT DOCUMENTS

DE 20 2006 003 938 U1 6/2006
DE 20 2006 011 296 U1 10/2006

OTHER PUBLICATIONS

Corrected International Search Report issued in corresponding International application No. PCT/SE2011/000044, mailing date Jul. 26, 2011.

(Continued)

*Primary Examiner* — Abigail Morrell
(74) *Attorney, Agent, or Firm* — Patent Portfolio Builders PLLC

(57) ABSTRACT

The invention relates to a device for securing a detachable cover for trimming or decorating at least one part of a button, which has a front side, a back side and, on its periphery, an edge side, said button being arranged on a base, e.g. a shirt. The cover has a front side and a back side and at least one wall side enclosing the edge side of the button, wholly or partially, said wall side has diameters of different lengths between its opposing inner sides or on the front side/back side of the cover, the longer diameter of which, at least two opposing points, is longer than the diameter of the button, wherein, when a pressure is applied radially from the outside towards the periphery of the cover at the points, the enclosing wall side and/or the cover is deformed at the same time as at least a second point located on a shorter diameter, and the enclosing wall side can be folded outwards in a direction from the center of the cover to create space for enclosing the edge side, whereupon, when the pressure is released, at least part of the inner side springs back against the edge side to secure the cover.

7 Claims, 2 Drawing Sheets

(56) References Cited

U.S. PATENT DOCUMENTS

Figure 1:
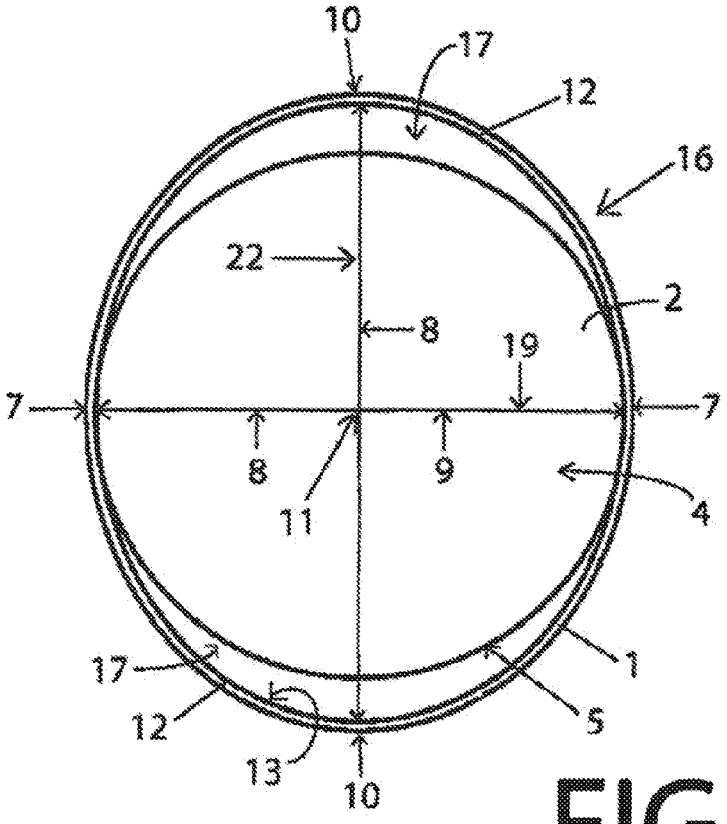

| | | | | |
|---|---|---|---|---|
| 3,651,972 | A * | 3/1972 | Itoh | 215/295 |
| D396,202 | S * | 7/1998 | Lindsay | D11/228 |
| 7,203,999 | B2 * | 4/2007 | Bagot | 24/113 R |
| 2008/0092346 | A1 * | 4/2008 | Andersen | 24/429 |
| 2010/0236028 | A1 | 9/2010 | Clark | |

OTHER PUBLICATIONS

Corrected International Preliminary Report on Patentability and Written Opinion of the International Searching Authority issued in corresponding International application No. PCT/SE2011/000044, mailing date Jul. 26, 2011.

* cited by examiner

DETACHABLE COVER FOR A BUTTON

The present invention relates to a device for fastening or securing a detachable cover trimming or decorating a button. The cover has a wall side which encloses the button, the inside of which side has diameters of different lengths, the longer diameter of which is longer than that of the button, wherein the cover is deformed by a radial pressure against the longer diameter and is folded outwards in a direction from the edge side, on which the diameter is shorter, wherein space is created around the edge side to enclose the button and thereafter release the pressure, whereupon the cover is locked firmly around the button.

In designs of the type in question available on the market covers are currently used to enclose buttons, which are arranged on a base, e.g. sewn into a shirt to decorate the buttons. The front of the button has colours, patterns or figures for creating different appearances for the purpose of decorating a garment for matching when the garment is used in different contexts. For example, the wearer may want to print a Logotype or a name on a cover which can be quickly applied to the button and removed on special occasions. Existing covers are often much larger than the button itself and are difficult to fasten and loosen since they match one button size and shape, which means that they are able to rotate and damage the base or cause the button to loosen according to U.S. Pat. No. 4,969,241, U.S. Pat. No. 3,425,101 or U.S. Pat. No. 1,077,721. Most decorated covers which are arranged on buttons can under no circumstances be replaced with another cover but are permanently secured. The entire button must therefore be replaced to apply a decoration on the front of the button. The above-mentioned designs are also complicated and expensive to manufacture.

One object of the present invention is to eliminate the drawbacks of the above-mentioned designs in that the cover is manufactured from a flexible material which has a wall side enclosing the button, the inside of which side has, at two opposing points, a longer diameter than that of the button, and at other points a shorter diameter, wherein the wall sides bend outwards when pressure is applied against the points from the outside towards the cover, where the diameter is largest, and constitute the edge side of the button where the diameter is shorter, wherein friction is created between the edge side of the button and the inside of the wall side is created when the pressure is released, locking the cover where the diameter is shortest.

Thanks to the invention a device has now been provided for securing and loosening the cover. The cover consists of a simple, low cost structure which enables the cover to be placed on and detached from the button easily and quickly without damaging the base to which the button is secured. The button has a front side, a back side and an edge side. According to the invention the cover consists of a resilient material. When the cover is placed on the button the front side of the button and the edge of the cover are enclosed. The front side of the cover has a rounded shape looking towards it, e.g. a circular, oval or elliptical shape. The enclosing wall side of the cover has an inner side. Between two opposing inner sides or on the front/back side of the cover it has diameters of different lengths or distances from each other, the longer diameter of which is longer, at two opposing points, than the diameter of the button. When radial pressure is applied, e.g. with a thumb and index finger directed to the points on the periphery of the cover towards its outer side in a direction towards the centre of the cover, the cover is deformed. The deformation is then transmitted to the enclosing wall side to a second point existing on it, where a shorter diameter is exhibited between the inner sides which are shorter than the longer diameter, where the transmitted deformation folds out the enclosing wall side in a direction running away from the centre of the cover. Space is then created along the entire inner side of the enclosing wall side between the edge side and inner side of the button, which causes an opening to be formed in the back side of the cover having approximately the same diameter along the entire inner side of the enclosing wall side, which diameter is longer than the diameter of the button. The cover can then cover the edge sides and front side of the button without any appreciable friction against the edge side of the button. When the pressure is released against the periphery of the cover, the folded out enclosing wall side encloses and springs back towards edge side of the button at points where the diameter is smallest and creates friction against the inner side of the enclosing wall side, which locks the cover enclosing the button. When the cover is detached from the button, pressure is again applied to the periphery of the cover on the longer diameter. The pressure is then reduced and the friction ceases against the edge side of the button or decreases considerably, whereupon the cover can be removed easily and quickly with the fingers of one hand. The cover has a flat or slightly bent front side, on which it is intended to arrange an illustration, e.g. with a colour, a pattern, an ornament or a figure. The cover consists of a thin layer with the same or varying thickness, which thickness is approx. 2-10% of the diameter of the button. The enclosing wall side may be thinner than the front side of the cover to achieve better resilient properties on the enclosing wall side. The cover may also be manufactured from a rather stiff, disc-shaped flexible plastic disc, which has resilient properties. The cover is manufactured by injection moulding, vacuum forming in a plastic material or punched out of a plastic disc.

Figure 2:
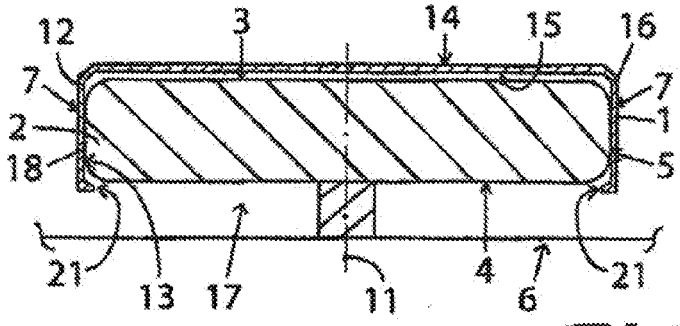
Figure 3:
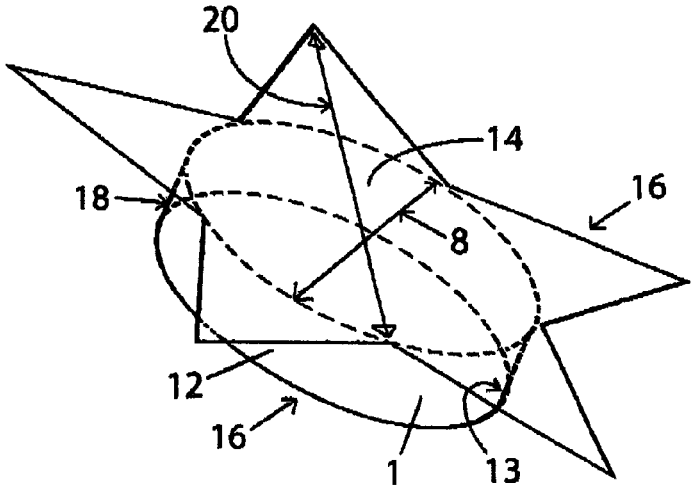
Figure 4:
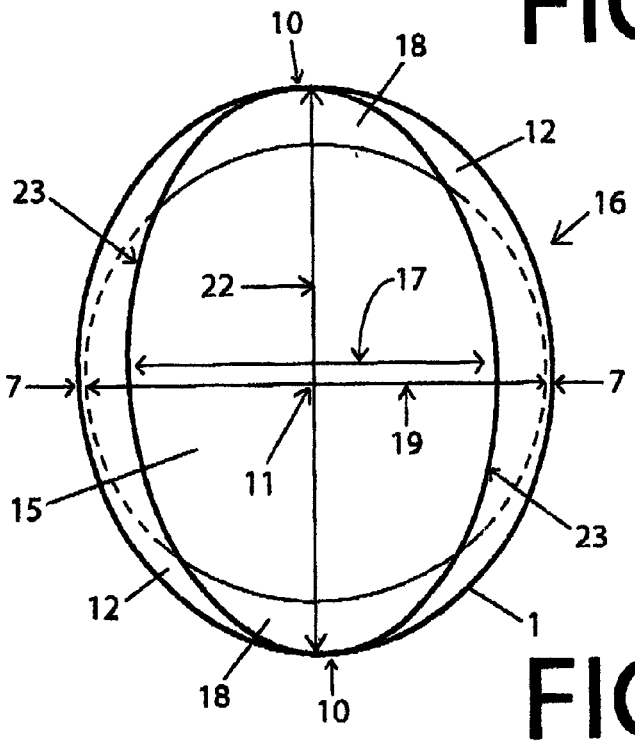

The invention is described in more detail by means of some preferred embodiments with reference to the attached drawings, in which FIG. 1 shows a view of a button trimmed with a cover viewed towards its back side, FIG. 2 shows a vertical cross-section through the cover and the button on the shorter diameter between two opposite inner sides, FIG. 3 shows a transparent perspective view of a cover, the front side of which has a greater diameter/width than the diameters of different lengths, FIG. 4 shows a view of a cover in the position of rest viewed straight towards its underside.

FIGS. 1-2 show a detachable cover 1, which trims a button 2, which has a front side 3, a back side 4 and an edge side 5. The button 2 is arranged on a base 6. The cover 1 has a front side 14, a back side 15 and a wall side 12 enclosing the edge side 5, which wall side has an inner side 13 which encloses the edge side 5 with diameters 8 of different lengths between the opposing inner sides 13, the longer diameter 22 of which, at two opposing points 10, is longer than the diameter 9 of the button 2. By applying radial pressure directed towards the points 10 against the outer side of the periphery of the cover 1 towards the enclosing the wall side 12, the cover 1 is deformed, whereupon, at a second point 7 of the enclosing wall side 12, on a shorter diameter 19, which is shorter than the diameter 22, enclosing wall side 12 is folded outwards in a direction away from the centre 11 of the cover 1 in order to create space for enclosing the entire edge side 5, whereupon, when the pressure is released, the enclosing outwardly folded wall side 12 springs back towards the edge side 5 and creates friction against the inner side 13 for locking the cover 1. In a variant of the invention the enclosing wall side 12 is of oval or elliptical shape where it connects to the back side 15 of the cover 1 at approximately 80-100 degrees, which is a side wall 18 projecting therefrom, said back side 15 faces towards the front side 3 of the button 2. The cover 1 is then shaped as a sleeve 16, which has an opening 17, viewed towards the back side 15 of the cover 1. When the cover 1 is applied, the button 2 is inserted in the opening 17 when the pressure is applied at the points 10, whereupon the pressure is released when the cover 1 is in the correct position, i.e. when the illustration on the front side 14 of the cover 1 is correctly orientated above the button 2. When the cover 1 is detached from the button 2, pressure is again applied to the points 10, whereupon the outward folding takes place on the shorter diameter 19, wherein the inner side 13 runs in principle freely from the edge side 5, which then enables the cover 1 to be easily detached. The difference between the longer diameter 22 and the shorter diameter 19 is approximately 2-20% or 1-5 mm to ensure that the cover does not look too oval and to ensure that the outward folding will not be too small when the cover 1 is applied to the button. The inner side 13 has projections 21 arranged as several pieces in a row, or as one longitudinal projection 21, which projects at least 0.2-2 mm in under the back side 4 of the button 2 from the inner side 13, when the cover 1 encloses the button 2 and retained by the friction to prevent the cover 1 from becoming loose from the button 2 when excessively pulled from the cover 1. Enclosing wall side 12 can also be peripherally divided into shorter pieces with intervening slots or spaces, so that the enclosing wall side 12 can be deformed more easily when pressure is applied against it.

FIG. 3 shows that the front side 14 of the cover 1 has, at certain points, a longer diameter/width 20 than the diameters 8 of different lengths, which means that when the cover 1 trims the button 2, the front side 14 of the cover 1 is prominent as a larger decorative surface. Buttons 2 can then be trimmed with the front side 14 of the cover 1, each of which may have diameters/widths 20 of different sizes to provide a varied image impression on one and the same base 6.

FIG. 4 shows that the periphery of the back side 15 of the cover 1 is in principle circular where the enclosing wall side 12 connects to the periphery. The enclosing wall side 12 inclines the most outwards from the centre 11 of the cover 1 at its outer end 23 to form the longer diameter 22 between two opposing inner sides 13, wherein the outer end 23 inclines the most towards the centre 11 of the cover 1, where the shorter diameter 19 between two opposing inner sides 13 is located, and that the inclination along enclosing wall side 12 gradually levels out between points 10. When the pressure is applied, the enclosing wall side 12 rights itself so that they are in principle perpendicular to the back side 15 of the cover 1. The opening 17 then becomes essentially circular. The diameters 8 of different lengths are then longer than the diameter 9 of the button 2, which enables the sleeve 16 to be detached and applied easily. This design of the sleeve 16 means that the difference between the shorter diameter 19 and the longer diameter 22 can be made slightly shorter than if enclosing the wall side 12 had been perpendicular before the pressure was applied to points 10, wherein the front side 14 of the cover 1 then looks more circular.

The invention claimed is:

1. A detachable cover configured for use with a button, comprising:

a front side;

a back side; and a wall side configured to enclose an edge side of the button wholly, said wall side having diameters of different lengths between opposing inner sides, including, a first diameter defined by two first opposing points and configured to be greater than a diameter of the button, and a second diameter defined by two second opposing points, the first diameter being greater than the second diameter, wherein, when a pressure is applied radially from an outside towards a center of the cover at the two first opposing points, the wall side is deformed at the two first opposing points at the same time as at the two second opposing points, the wall side being folded outwards at the two second opposing points in a direction from the center of the cover to create space configured to enclose the edge side of the button, whereupon, when the pressure is released, at least part of the opposing inner sides including the two second opposing points is configured to spring back against the edge side of the button to secure the detachable cover to the button, wherein the cover is shaped as a sleeve, wherein the wall side constitutes a side wall projecting from the back side of the detachable cover, said side wall is oval or elliptical in shape viewed towards the back side of the detachable cover and forms an opening, wherein, when the pressure is applied, the opening can be formed into a more circular opening for attaching or detaching the cover to or from the button, wherein the back side of the cover or the front side of the cover is circular along the periphery of the cover, to which the wall side connects, said wall side inclining the most outwards away from the center of the cover in order to create the first diameter between the two first opposing points, said first diameter being greatest at an outer end of the wall side, wherein the second diameter between the two second opposing points is located at the outer end of the wall side, where the wall side inclines the most inwards towards the center of the cover.

2. The detachable cover according to claim 1, wherein the wall side has a projection which projects at least 0.2 mm from the wall side towards the center of the cover under the back side of the button.

3. The detachable cover according to claim 1, wherein the difference between the first diameter and the second diameter is 2-20%.

4. The detachable cover according to claim 1, wherein said inclinations gradually level out between points along the entire extent of the wall side before the pressure is applied against the wall side of the cover whereupon, when the pressure is applied against the two first opposing points, the wall side is at an angle of 80-100 degrees to the back side of the cover along the entire wall side, wherein the opening is formed, said opening is configured to be oval or elliptical in shape and to have diameters of different lengths greater than the diameter of the button such that the sleeve can be attached or detached.

5. The detachable cover according to claim 1, wherein the front side of the cover has a width greater than the diameters of different lengths.

6. The detachable cover according to claim 1, wherein the front side of the cover constitutes a space intended for an illustration, an image, an ornament or a figure.

7. The detachable cover according to claim 1, wherein the cover consists of a thin layer of varying thickness, which is 2-10% of the diameter of the button, wherein the wall side has a thinner thickness than a thickness of the front side of the cover.

* * * * *